US012434797B2

(12) United States Patent
Brataas et al.

(10) Patent No.: US 12,434,797 B2
(45) Date of Patent: Oct. 7, 2025

(54) SPORTS BAG WITH PROTECTIVE RIBS

(71) Applicant: DB Equipment AS, Oslo (NO)

(72) Inventors: Truls Kristian Brataas, Oslo (NO); Henrik J. S. Kax, Johanneshov (SE)

(73) Assignee: DB Equipment AS, Oslo (NO)

( * ) Notice: Subject to any disclaimer, the term of this patent is extended or adjusted under 35 U.S.C. 154(b) by 142 days.

(21) Appl. No.: 18/546,186

(22) PCT Filed: Feb. 11, 2022

(86) PCT No.: PCT/NO2022/050038
§ 371 (c)(1),
(2) Date: Aug. 11, 2023

(87) PCT Pub. No.: WO2022/173311
PCT Pub. Date: Aug. 18, 2022

(65) Prior Publication Data

US 2024/0132183 A1 Apr. 25, 2024
US 2024/0227989 A9 Jul. 11, 2024

(30) Foreign Application Priority Data

Feb. 12, 2021 (NO) ..... 20210186

(51) Int. Cl.
*B63B 32/87* (2020.01)
*A45C 7/00* (2006.01)
(Continued)

(52) U.S. Cl.
CPC ..... *B63B 32/87* (2020.02); *A45C 7/0077* (2013.01); *A45C 13/36* (2013.01); *A45F 3/04* (2013.01)

(58) Field of Classification Search
CPC ..... A45C 13/36; A45C 7/0077; B63B 32/87
(Continued)

(56) References Cited

U.S. PATENT DOCUMENTS 5,094,344 A * 3/1992 Savage ..... B63B 32/87 441/74
5,405,002 A * 4/1995 Troia ..... B63C 13/00 206/335

(Continued)

FOREIGN PATENT DOCUMENTS

AU 2021103368 A4 8/2021

OTHER PUBLICATIONS

PCT International Search Report and Written Opinion for International Application No. PCT/NO2022/050038 filed on Feb. 11, 2022; Date of Mailing: Jun. 22, 2022; 6 pgs.

(Continued)

*Primary Examiner* — Steven A. Reynolds
(74) *Attorney, Agent, or Firm* — Alix, Yale & Ristas, LLP

(57) ABSTRACT

A bag for carrying sports equipment includes an upper wall, a bottom wall, and a side panel extending between the upper wall and bottom wall to form an enclosure for containing the sports equipment, wherein the upper wall is removably coupled to the side panel along at least a part of its perimeter to provide access to the enclosure; a first strengthening rib comprising a first rib section extending laterally across the upper wall, a second non-foldable rib section extending across the side panel on a first side of the bag, a third non-foldable rib section extending laterally across the bottom wall, and a fourth non-foldable rib section extending across the side panel on a second side of the bag opposite the first side, wherein the rib sections are arranged to abut each other such that they completely surround the enclosure: at least one foldable region adjacent the first strengthening rib.

20 Claims, 6 Drawing Sheets

(51) Int. Cl.
*A45C 13/36* (2006.01)
*A45F 3/04* (2006.01)

(58) Field of Classification Search
USPC ..... 206/315.1; 190/107, 25
See application file for complete search history.

(56) References Cited

U.S. PATENT DOCUMENTS 6,003,745 A * 12/1999 Mechanic ..... A45C 9/00 5/420
6,244,399 B1 * 6/2001 Birkestrand ..... A45C 5/14 190/114
6,401,890 B1 * 6/2002 Tan ..... A45C 7/0036 150/159
6,450,333 B1 * 9/2002 McClenahan ..... B65D 21/086 220/8
9,010,559 B2 * 4/2015 Boyles ..... A45C 7/0031 206/315.3
2003/0101511 A1 * 6/2003 Gotfried ..... B63B 32/87 5/413 R
2006/0016842 A1 * 1/2006 Lu ..... A45C 13/36 224/605
2006/0289584 A1 * 12/2006 Lu ..... A45C 7/009 224/616
2009/0283436 A1 * 11/2009 Carcamo ..... B63B 32/87 206/522
2011/0083933 A1 * 4/2011 Engel ..... A45C 7/0077 190/107
2013/0334081 A1 * 12/2013 Loudenslager ..... A63B 55/406 29/454
2014/0339109 A1 * 11/2014 Van Emden ..... B65B 23/00 53/446
2015/0122677 A1 5/2015 Norrie
2015/0197320 A1 * 7/2015 Ventura ..... A45C 5/14 220/7
2015/0216277 A1 * 8/2015 Boyles ..... F41C 33/06 220/8
2016/0083055 A1 * 3/2016 Coleman ..... B63B 32/87 206/315.1
2018/0050770 A1 2/2018 Warll
2022/0079312 A1 * 3/2022 Bladd-Symms ..... A45C 5/14

OTHER PUBLICATIONS

Norwegian Examination Report/Office Action for patent application No. 20210186, Dated: Sep. 12, 2021, 4 pgs.
Norwegian Search Report for patent application No. 20210186, Date of Report: Sep. 12, 2021, 2 pgs.

* cited by examiner

SPORTS BAG WITH PROTECTIVE RIBS

BACKGROUND

The present invention relates to a bag with protective ribs, and more particularly to a foldable bag with a protective ribcage, which is suitable for holding sports equipment such as a sports board or surfboard. The bag can be used to protect and transport equipment of different sizes. The protective ribbing may be provided in the form of a 360 degree ribcage structure, as described in more detail below.

The board sports industry is one of the fastest growing action sport industries in the world, and has a wide following spanning all age groups. This is at least partly due to the fact that it requires comparatively little equipment. In order to surf, for example, only a single lightweight board is required, however more advanced amateur surfers and pro surfers often prefer to tailor their equipment to the location and weather.

Particularly pro-surfers, who travel extensively and have more specific requirements when it comes to the type and size of board they use, will carry several boards with them at any time. They will often need to transport two or more boards through airports, back and forth between airports and hotels, and to and from the beach. It is therefore common to carry boards and additional equipment within a single bag with a strap or wheels for ease of transport. The boards used by pro-surfers are also likely to be valuable and need to be properly protected during transit.

Existing bags of this type are either soft and lacking sufficient reinforcement altogether, or are made in the form of a hard shell (as in US-A-2015/216277). The padding is either not sufficient to provide the required level of protection to the equipment inside the bags, or the bag is heavy and there is no possibility of folding or compressing it to a smaller size for transport when it is not being used. The requirement of providing adequate protection to sports equipment, and in particular surfboards, has therefore in the past meant that the bags have been overly bulky and heavy, and that ease of transport and convenience has necessarily been sacrificed.

SUMMARY

According to a first aspect of the present invention, there is provided a bag for carrying sports equipment comprising: an upper wall, a bottom wall, and a side panel extending between the upper wall and bottom wall to form an enclosure for containing the sports equipment, wherein the upper wall is removably coupled to the side panel along at least a part of its perimeter to provide access to the enclosure; a first strengthening rib comprising a first rib section extending laterally across the upper wall, a second non-foldable rib section extending across the side panel on a first side of the bag, a third non-foldable rib section extending laterally across the bottom wall, and a fourth non-foldable rib section extending across the side panel on a second side of the bag opposite the first side, wherein the rib sections are arranged to abut one another such that they completely surround the enclosure: and at least one foldable region adjacent the first strengthening rib.

The first rib-section may represent a protected region which is less bendable that the adjacent soft foldable region, but which is not completely non-foldable as for the other ribs. This rib section may comprise one or more additional layers of material than are present in the foldable regions, for example. The additional layer may be a thermoformed EVA panel/press-moulded EVA. In embodiments, the first rib section is also non-foldable so that a fully encircling rib of abutting non-foldable rib sections is provided.

The foldable region may comprise one or more foldable panels having a certain width measured in a direction from the front to the rear of the bag (i.e. in a lateral direction along line A in the case of the surfboard bag shown in the figures). This width may be equal to or larger than the width of the rib section on the same wall. The foldable region may extend around all four walls of the bag, and may comprise four foldable panels of equal width extending along each wall to encircle the bag adjacent the rib.

Reference to a rib section being non-foldable is to the whole of the rib section being non-foldable. The upper wall may be a lid, in which case it is removably coupled to the side panel along the whole perimeter apart from a hinge section about which the upper wall can be flipped to open the bag. Reference to the rib sections abutting one another is to the ends of the rib sections being adjacent one another. Abutting rib sections will have their ends close together with nothing in between apart from thin intervening material layers or a structure such as a seam or the means for removably fastening the upper wall (usually a zip). Seams, zips, or similar structure may be present between each rib section and the adjacent two rib sections, but no additional wall regions or wall panels will be. There may be less than 3 cm, preferably less than 1 cm, and most preferably less than 5 mm distance between the end of the hard panel forming one rib section and the end of the hard panel forming the next rib section. In order to encircle the enclosure, the longitudinal position of at least a part of each rib section and the rib sections in the adjacent two walls is the same, so that the longitudinal positions of the adjacent rib sections overlap, and these rib sections extend all of the way across the respective walls of the bag from one side to another.

The bag combines an increased protective capability provided by the strengthening rib sections with more flexible foldable regions which allow the bag to be converted to a more compact form and which decrease the weight of the bag. The rib is configured to extend in a lateral direction to completely surround the bag, providing protection against potentially damaging force from all directions. The bag is able to stand in an assembled form without collapsing, which is also a result of including one or more ribs which completely surround the structure. The bag is formed of one or more layers of material with additional strengthening panels forming the ribs, and is not inflatable.

Reference to the first rib and foldable region being adjacent one another is to them being directly adjacent or abutting on another (with or without a seam in between). A foldable panel may be provided adjacent at least one of the four rib sections, and preferably adjacent each of the four rib sections.

In embodiments, the first, second, third, and fourth rib sections are positioned at the same longitudinal distance along the bag from an end of the upper wall. The first, second, third, and fourth rib sections may be positioned along the length of the bag within the middle third, i.e. less than one sixth of the length of the bag from the middle in a longitudinal direction.

In embodiments, the side panel comprises two side walls, a front wall, and a rear wall, and the first, second, third, and fourth rib sections are positioned at the same longitudinal distance along the bag between around a third of the distance from the rear wall to the front wall and two thirds of the distance from the rear wall to the front wall.

In embodiments the first, second, third, and fourth rib sections have a constant width that is the same for each of the rib sections. The rib sections may be of the same width and located at the same longitudinal position along the length of the bag.

In embodiments, the at least one foldable region extends around each of the upper wall, the bottom wall, and the side panel on the first and second sides of the bag. The foldable region thus also extends across the bottom wall, up the side panel on the first side of the bag, across the upper wall, and down the side panel on the second side of the bag. The width of the foldable region may be equal to or larger than the width of the first rib. The foldable region may comprise one or more foldable panels.

In embodiments, the bag comprises a second strengthening rib offset laterally from the first strengthening rib, the second strengthening rib having the same structure as the first strengthening rib, wherein the foldable region is located between the first and second strengthening ribs. In embodiments, the whole of the upper wall, side panel, and bottom wall between the first and second strengthening rib is foldable. A ribcage-like structure is therefore provided, affording good protection in a bag that is still lightweight and foldable. Reference to the second strengthening rib having the same structure as the first strengthening rib is to it also being comprised of four rib sections extending across the upper wall, down one side of the bag, across the bottom wall, and up the other side of the bag respectively with the rib sections abutting one another to completely surround the enclosure. In embodiments, all rib sections of the second rib are non-foldable.

In embodiments, the bag comprises a third strengthening rib offset laterally from the first and the second strengthening ribs, the third strengthening rib having the same structure as the first and second strengthening ribs, wherein the upper and bottom walls are elongated and the ribs are spaced longitudinally along the bag so as to be located adjacent a first end, about half way along the bag from the first to the second end, and adjacent a second end of the bag respectively.

Any number of ribs can be provided along the length of the bag, but two or three encircling ribs spread out along the length of the bag generally provides a good balance between strength and flexibility for converting to a compact form. If the bag is divided longitudinally into three equal length regions, then the middle rib will be located within the central region. The first and third ribs may be located respectively within the two outermost regions and will each therefore generally not be more than a distance equal to a third of the total length of the bag from each end. In some examples, the first and third ribs will not be more than a distance equal to a fourth of the total length of the bag from each end. In general, the longitudinal distance between the first and second ribs and between the second and third ribs will be approximately the same.

In embodiments, the whole of the upper wall, side panel (forming two sides or side walls), and bottom wall between the first and second strengthening ribs, and between the second and third strengthening ribs is foldable. A material that can be folded or is foldable refers here to a material that can be manipulated or bent such that non-adjacent regions of the material can be brought into and out of contact with each other. Manipulation or bending of the material of the foldable region so that non-adjacent areas of this part can be brought into contact with each other should be able to be carried out by a person of normal strength without any additional help (from a machine or tool, for example). For a non-foldable region, a person of normal strength will not be able to bend the material to bring non-adjacent regions in contact without the assistance of a machine or tool.

In embodiments, the width of the strengthening ribs increases from one end of the bag to the other. The width refers to the size of the rib in a longitudinal direction (i.e. in a direction perpendicular to that along which the rib extends across the bag from side to side or bottom to top).

In embodiments, the bag is a surfboard bag. The upper and bottom walls may therefore be shaped and sized to be able to contain one or more boards. The shape of the upper and bottom walls may resemble the shape of a surfboard and may therefore be of an elongated shape, such as elliptical or oval.

In embodiments, the side panel comprises two side walls, a front wall, and a rear wall, and the bag comprises a pair of diagonal folds adjacent the front wall of the bag and extending across the side panel from the bottom wall to the upper wall on either side of the bag such that the side panel preferentially folds along the diagonal folds to compress the front wall of the bag down flat. The front wall refers only to a region of the side panel which faces in a direction roughly perpendicular to the side walls. The front is usually flat but may also be curved. In some cases, the front wall is reinforced by way of a strengthening panel or several strengthening panels (such as a thermoformed EVA panel/press-moulded EVA) and the edge of the front wall can be defined as being coincident with the edges of this or these panels. The front wall will include at least a region either side of the very foremost part of the side panel. The rear wall can be defined similarly. The EVA increases the strength of the front and back walls if present, but these may still be bendable.

In embodiments, the side panel between each of the pair of diagonal folds and the front wall of the bag is foldable. Including a foldable region here allows the diagonal fold to be used to easily compress the front wall down flat, because the foldable region bows outwards between the diagonal fold and the front wall as the front wall is pushed down.

In embodiments, the bag comprises a second pair of diagonal folds at the other end of the bag for also compressing the rear wall of the bag down flat. A similar foldable region may be included between the rear pair of diagonal folds and the rear wall to provide the same easy compression function as in the case of the front wall above. This foldable region is a foldable panel or area of the bag.

In embodiments, the upper wall is coupled to the side panel via a hinge region at the front or rear end of the bag, and the bag can be opened by flipping the upper wall outwards about the hinge. This is an important feature in terms of achieving a compact configuration because the upper wall can be rolled separately from one end and then rolled into the rest of the bag. A smaller size for the compact configuration can therefore be achieved.

In embodiments, the bag is convertible from an assembled configuration wherein the upper wall, bottom wall, and side panel form the enclosure to a compact configuration by opening the upper wall out at the hinge and rolling the upper wall up from the free end towards the hinge, collapsing the side walls of the bag inwards, compressing the front and rear end walls of the bag flat by folding the side panel along the two pairs of diagonal folds, and rolling the bottom wall and side walls around the upper wall.

In embodiments, the bag comprises fastening means on the bottom wall for cooperating with fastening means on the rear wall of the bag to secure the bag in its compact form. The fastening means may comprise one or more loops located on the underside of the bag and one or more hooks on the rear wall. These should be positioned such that when the bag is in its compact configuration the hooks can be inserted through the loops to fix.

In embodiments, the first, second, third, and fourth rib sections are formed as four separate panels within each of the upper wall, bottom wall, and the two side walls.

The rib sections extending across both of the sides, bottom, and top of the bag are therefore formed as four separate sections or panels within each of the upper wall, bottom wall, and the two side walls. Three or all four of the rib sections may be non-foldable. This provides a hinge between the separate panels which allows the sides of the bag to collapse towards the centre of the bag during folding of the bag into its more compact form. The additional layers of material (such as EVA and/or foam) help the bag to hold its coffin-like shape when it is not folded for storage or transport.

In embodiments, the foldable region is a foldable panel.

According to a second aspect of the present invention, there is provided a bag for carrying sports equipment comprising: an upper wall, a bottom wall, and a side panel extending between the upper and bottom wall configured to form an enclosure for containing the sports equipment, wherein the side panel comprises two side walls, a front wall, and a rear wall, and wherein the bag comprises a pair of diagonal folds adjacent the front wall of the bag and extending across the side panel from the bottom wall to the upper wall on either side of the bag such that the side panel preferentially folds along the diagonal folds to compress the front wall of the bag and at least a portion of the side walls down flat.

In embodiments, the bag is a bag for a sports board. In embodiments, the bag is a surfboard bag. In embodiments, the upper and bottom walls are elongated. In this way the walls are shaped to fit a sports board such as a surfboard.

In embodiments, the side panel between each of the pair of diagonal folds and the front wall of the bag is foldable.

In embodiments, the bag comprises a second pair of diagonal folds at the other end of the bag for also compressing the rear wall of the bag down flat.

In embodiments, the upper wall is coupled to the side panel via a hinged region at the front or rear end of the bag, and wherein the bag can be opened by flipping the upper wall outwards about the hinge.

In embodiments, the bag is convertible from an assembled configuration wherein the upper wall, bottom wall, and side panel form the enclosure to a compact configuration by opening the upper wall out at the hinge and rolling the upper wall up from the free end towards the hinge, collapsing the side walls of the bag inwards, compressing the front and rear end walls of the bag flat by folding the side panel along the two pairs of diagonal folds, and rolling the bottom wall and side walls around the upper wall.

In embodiments, the bag comprises fastening means on the bottom wall for cooperating with fastening means at the rear end of the bag to secure the bag in its compact form.

According to a third aspect of the present invention, there is provided a bag for carrying sports equipment comprising: an upper wall, a bottom wall, and a side panel extending between the upper wall and bottom wall to provide a first and second side wall and to form an enclosure for containing the sports equipment; a first strengthening rib comprising a first non-foldable rib section extending laterally across the upper wall, a second non-foldable rib section extending across the side panel on a first side of the bag, a third non-foldable rib section extending laterally across the bottom wall, and a fourth non-foldable rib section extending across the side panel on a second side of the bag opposite the first side, wherein the rib sections are arranged to abut each other such that they completely surround the enclosure: at least one foldable region adjacent the first strengthening rib. The upper or bottom wall may be removably coupled to the side panel to provide access to the enclosure.

According to a fourth aspect of the present invention, there is provided a bag for carrying sports equipment comprising: an upper wall, a bottom wall, and a side panel extending between the upper wall and bottom wall to form an enclosure for containing the sports equipment, wherein the upper wall is removably coupled to the side panel along at least a part of its perimeter to provide access to the enclosure; a first strengthening rib comprising a first non-foldable rib section extending laterally across the upper wall, a second non-foldable rib section extending across the side panel on a first side of the bag, a third non-foldable rib section extending laterally across the bottom wall, and a fourth non-foldable rib section extending across the side panel on a second side of the bag opposite the first side, wherein the rib sections are arranged to abut one another such that they completely surround the enclosure: and at least one foldable region adjacent the first strengthening rib.

BRIEF DESCRIPTION OF THE DRAWINGS

Embodiments of the present invention will now be described, by way of example only, with reference to the following diagrams wherein.

DETAILED DESCRIPTION

Figure 1:
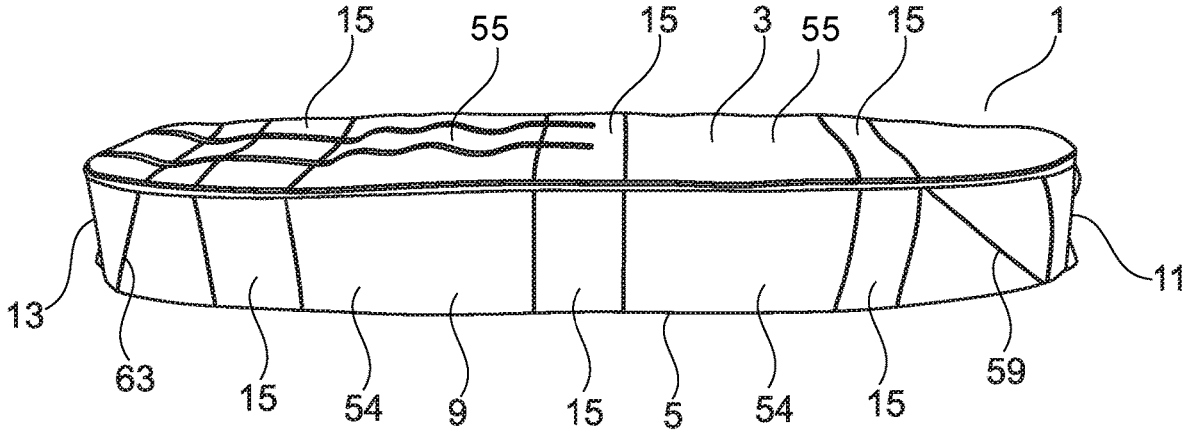
FIG. 1 shows a plan view of a bag.

FIG. 1 shows a bag, including strengthening ribs, which is designed to carry one or more surfboards. The bag 1 in this case is coffin-shaped, in that it is formed from an upper wall 3, a bottom wall 5 having the same shape as the upper wall, and a side panel 7 extending between the upper and bottom walls. The side panel forms two side walls 9, a front wall 11, and a rear wall 13. An enclosure is therefore formed by the upper and bottom walls and the side panel which can contain equipment. Generally, the walls of the bag will completely surround the contents when the bag is closed. In some cases (such as where the bag is designed to carry only a single board) the side wall can be dispensed with, so that the upper and bottom walls are simply attached together at their edges.

A zipped opening can be provided along one or more sides and/or ends of the bag to allow a board or boards to be inserted or removed. The side panel 7 may be formed as a continuous piece of material extending all of the way around the bag to enclose the equipment within. The coffin-shaped bag shown in the figures is suitable for carrying at least two surfboards stacked one on top of another.

Where the bag is designed specifically to hold one or more surfboards (as in the example shown in the figures), the area at the front of the bag designed to hold the nose of a surfboard can be referred to as the nose end of the bag and the area at the opposite end designed to hold the tail of the board as the tail end. The side panel 7, which in this case is a continuous piece, extends around the bag to form the two side walls 9, the front wall 11 and the rear wall 13. A longitudinal direction refers to a direction extending between the nose end of the bag and the tail end shown as line A in FIG. 2, and a lateral or transverse direction refers to a direction extending perpendicular to this, from one side of the bag to the other.

The side panel 7, and also in some cases the upper 3 and lower 5 walls, may each be formed of a number of separate parts coupled together either permanently or removably via Velcro® zips, or similar, however generally it is preferred that the bag is only openable via unfastening (e.g. unzipping) a section of the upper wall from the side panel in order to minimise the likelihood that it will open during transit. The upper and bottom walls of the bag may be similarly shaped as an elongated ellipse or oval, as shown in the figures, in order to match the shape of the boards inside. In other examples the bag may be differently shaped, for example it may be rectangular, in which case the transition from the side walls to the rear and front walls will be more defined and will form an edge or a corner.

The bag 1, in a preferred embodiment, includes an upper wall 3 which provides a lid and which is hinged at one end (the nose or tail end), rather than at the side. This can be important for allowing compression of the bag into its folded form for transport, as will be described in more detail below.

The walls of the bag 1 can be formed from a number of different layers of material. The innermost layer will generally comprise a lightweight material, such as polyester, and may be waterproof. One or more layers of foam (e.g PE foam) or another flexible padding material can be provided between the innermost layer and the outermost layer of the bag, and the outermost layer can be formed of any strong fabric which is resistant to tearing, such as nylon. The outermost layer may also be waterproof. This layered structure including an inner fabric layer, an outer fabric layer which will usually be strong and tear resistant, and one or more foam interior layers will form the foldable regions of the bag, and can be provided across the whole of the upper wall 3, bottom wall 5, side walls 9, front wall 11 and rear wall 13 (which together make up the side panel 7) of the bag. Some parts of the walls will include additional or alternative layers for reinforcement and to provide the protective 360 degree ribcage structure, which will be described in more detail below. In some cases one or more of the interior layers (e.g the foam padding) can be replaced with reinforcing panels in the regions forming the rib or in other reinforced regions of the bag), or these can be provided in addition to the padding.

The ribcage structure is formed of a number of strengthening rib sections in the form of panels, which can be inserted within pockets sewn into the material of the bag. Together, a number of rib sections form a rib which extends laterally all of the way around the bag. The regions between the rib sections comprise seams and the bag can be folded along these seams, but the rib sections themselves are not foldable. The rib sections abut each other at the seams, meaning that although the reinforcing panels forming the rib sections may not physically touch each other, they each contact the same seam on either side. In the case of the upper wall a zip or another fastening apparatus for opening and closing the lid of the bag may be present between the rib sections rather than a normal seam.

In addition to the foam layer(s) and the inner and outer fabric layers, or instead of one or more of the interior layers, the reinforced regions forming the rib sections will include a layer of a stiffer material. The material may comprise a panel of plastic, fiberglass, metal or metal alloys (such as aluminium or aluminium alloy), wood, or any other material which has a certain stiffness and strength. The panel may have a honeycomb structure for additional strength. In some cases, these rib sections are not bendable by a person unassisted, and in some cases they may be bendable to a minimal extent in order to help to prevent ripping of the outer layers of fabric. In any case, the parts of the walls of the bag which form the rib sections are not foldable or collapsible. This is in contrast to the regions between the ribs which comprise only soft layers (e.g. only foam interior layers). Rib sections may include additional materials such as EVA panels (possibly press-moulded) as well as the strengthening panels mentioned above. Reinforced regions or rib sections 15 are shown in FIG. 1, and these together form a series of ribs which each extend all of the way around the bag. As mentioned, one of the ribs may not include the reinforcing material, and may be more bendable than the other rib sections. This rib can, for example, include EVA panels but not the plastic/metal strengthening boards included in the other rib sections. Some protection is still provided to the contents from knocks from above in this case (or from behind if the bag is intended to be carried as a rucksack), however a fully encircling rib including four sections of non-bendable material is preferred.

The panels forming the rib sections may be removable or may be permanently sewn into the layered fabric of the bag. In some cases, the pockets configured to contain the ribs may be opened and closed using a Velcro® tab or similar in order to remove and/or replace them. In some cases, only the reinforcing rib sections on the sides of the bag may be removable, whilst the rib sections on the upper and bottom walls of the bag are permanently sewn in such that they cannot be removed without cutting through the exterior layers of the fabric of the bag. All of the reinforcing rib sections may be removable in some embodiments, but this will result in a more complex overall structure with many Velcro® seals, buttons, zips, or similar to keep the various pockets closed.

The parts of the bag walls or the panels which do not include additional reinforcing layers are flexible/bendable and foldable so that the majority of the bag is able to be rolled or deformed at least to some extent. The flexible portions can be slightly padded, but they will still be bendable enough to roll or fold that part of the bag. The side wall 7 and the upper 3 and lower 5 walls of the bag may be formed from one, two, or more layers of foam, such as PE-foam as mentioned above. The foam layers may each be between 1 mm and 20 mm thick, preferably between 5 mm and 15 mm thick, and preferably around 10 mm thick. Where only the inner fabric layer, the one or more foam layers, and the outer fabric layer are present, the bag will be soft, flexible, and foldable and is not considered to be reinforced.

The sections of the bag where the rib sections are present are generally not rollable, in some cases are not bendable at all, and cannot be folded, but instead comprise inserts which result in these sections having a higher strength and stiffness than at least some of the adjacent regions of the bag walls. The rib sections are stiff enough that when the bag is in its assembled configuration, the sides of the bag where the rib sections are present will not completely collapse by bowing outwards when pressure is applied from above, for example due to a person leaning on the bag. A material that can be folded refers here to the ability to bend the material such that regions of the section of material that are not adjacent can be brought into and out of contact with each other. The regions forming the separate rib sections cannot be folded. If the rib sections extend across the side wall, they can therefore provide resistance to collapsing of the bag structure as a result of pressure from above and below, and are also hard enough to provide good protection from sideways knocks. This is extremely beneficial in terms of protecting the boards inside the bag from damage during transit, and is particularly useful when the bag and its contents are loaded as luggage in a plane storage hold or similar, where heavy items may be stacked on top of it for extended periods. Rib sections extending across the upper and bottom walls similarly prevent collapse of the bag under pressure from the sides and prevent damage to the contents from objects hitting the bag from above or below.

The one or more protective ribs formed of rib sections may each extend all of the way around the bag. Rib sections are provided at the same longitudinal distance from the nose end of the bag (or from the tail end) in the upper and bottom walls and in the side walls. By including more than one protective rib along the length of the bag, each of which completely encircles or surrounds the enclosure formed by the bag in this way, a ribcage-like structure can be formed. This provides excellent protection to the equipment within the bag from pressure or knocks from all directions at the same time as minimising weight and leaving enough flexibility to allow the bag to be compressed by folding as described below. The bag cannot be rolled or folded by normal force applied by a person where the rib sections are present, but is more flexible and can be folded in the areas or sections of the upper, lower, and side walls that are located between the ribs. The ribs ensure that the bag remains in its coffin-shaped configuration even when empty, until action is taken to covert the bag to its compact configuration.

Three encircling protective ribs are visible in FIG. 1 as ribs formed of rib sections 15. One rib is located near to the tail end of the bag, one in the middle, and another near to the nose end. The ribs extend all of the way around the bag as can be seen from a combination of FIGS. 2, 3, 4, and 5 which show the upper wall from above, bottom wall from below, first side wall and second side wall respectively. The reinforcing panels forming the rib sections, which extend laterally across the upper surface of the bag, are visible in FIG. 2. Here, three separate ribs are included, and this provides ample protection to the board within whilst allowing for folding (as described below). More or fewer protective panels can be included in some cases. The panels or rib sections extend all of the way from one side of the bag to the other. Rib sections in the side of the bag extend all of the way from top to bottom, and rib sections in the bottom wall and on the top wall of the bag also extend all of the way from one side of the bag to the other. This way each of the one or more ribs, formed from abutting rib sections, can completely surround the enclosure which improves protection.

Figure 3:
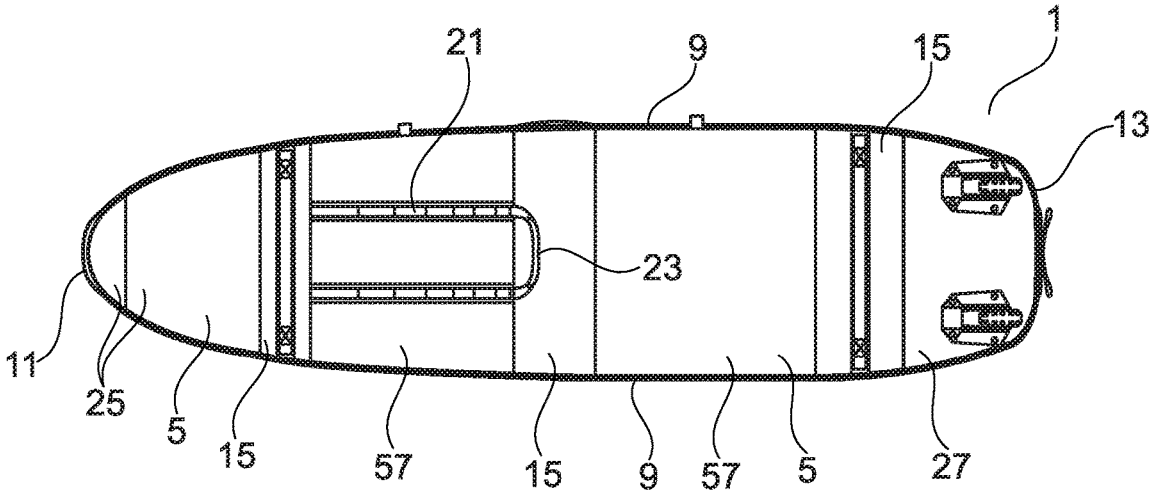
FIG. 3 shows a view of the bag of FIGS. 1 and 2 from below.
Figure 4:
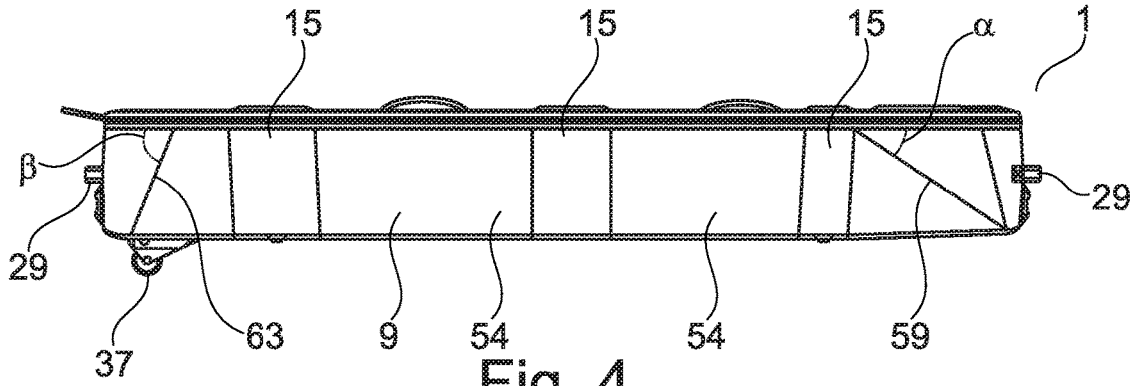
FIG. 4 shows the bag of FIGS. 1 to 3 from a first side.

The upper wall is provided with straps 17 for attachment of other bags or equipment, or for use as a carrying strap or handle. Two straps are shown, but one or any number of straps can be present. The straps may include a number of loops which provide fastening points for hooks or clips on the additional bags or equipment. Two carrying handles 19 are shown coupled to the upper wall. Any number of handles, or no handles, can be provided as desired. Handles and straps can be removable in some cases or retractable into pockets as described in more detail below. This way the bag is flexible enough to be adapted to different situations and different uses. The underside of the bag is shown in FIG. 3. An attachment rail 21 is coupled to the bottom wall near to the front of the bag. The attachment rail may comprise two parallel rows of fastening loops as shown, or may comprise one or more than two rows if desired. There may be one loop in each row, but providing more than one allows for easier fastening. In the example shown in the figures, a carrying handle 23 is provided between the two rows of loops for convenience, but this need not be case. The attachment rail 21 allows the bag to be fastened in its compact configuration as will be described below. If the bag is intended to be carried as a rucksack, shoulder straps may be provided on the lower wall in place of or as well as the strap(s) or handle coupled to the upper wall. The bag will then be carried so that the lower wall is positioned facing and adjacent the wearer's back. In the case of a surfboard bag, however, the bag is designed to receive a surfboard so that the underside sits closest to the lower wall, as shown in the figures.

The rib sections of the encircling protective rib extending down one side of the bag, across the bottom wall, and up the other side may be formed from one piece of stiff material such that the second, third, and fourth rib sections are formed of one piece. Alternatively, the rib can be formed as one integral piece with all four rib sections provided together as a single hoop or rib. The opening to provide access to the bag will not in this case extend as far along the bag as the rib. Any two or more of these sections may be integrally formed, however it will be preferable for the rib sections extending across both of the sides, bottom, and top of the bag to be formed as four separate sections included or inserted in each of the upper wall, bottom wall, and the two side walls. This provides a natural hinge between the separate panels which allows the sides of the bag to collapse towards the centre of the bag during folding of the bag into its more compact form. A convenient way to provide the rib sections is to insert sheets of stiff reinforcing material into pockets within the lining of the bag. As mentioned, these sheets may be permanently sewn into the lining or may be removable.

The stiff material used to form the ribs or rib sections of the ribcage structure may be formed of one or more of plastic (such as polyethylene), fiberglass, metal or metal alloys (such as aluminium or aluminium alloy), and wood, as mentioned above. The reinforcing panels forming the rib sections may be provided in the form of flat sheets having a thickness between 0.1 cm and 2 cm, preferably between 0.5 cm and 1.5 cm, more preferably around 1 cm. The sheets may have a gridded structure rather than being formed as solid plates, such as a honeycomb structure, in order to both maximise strength and minimise weight. The reinforcing panels (such as the plastic honeycomb panels) forming the rib sections may be of around the same thickness as the one or more foam layers described above. The reinforcing panels, and the pocket in which it is inserted if present, should be sized and shaped so that they extend all of the way across the upper and bottom walls of the bag from one side to another, and from top to bottom of the side walls of the bag in order to completely encircle the enclosure and provide full protection. As mentioned above, additional layers, such as press-moulded EVA, may be added to the rib sections along with the reinforcing panels. One of the rib sections, such as that extending across the upper wall, may have the reinforcing panel omitted, or all of the rib sections may include reinforcing panels.

Figure 7:
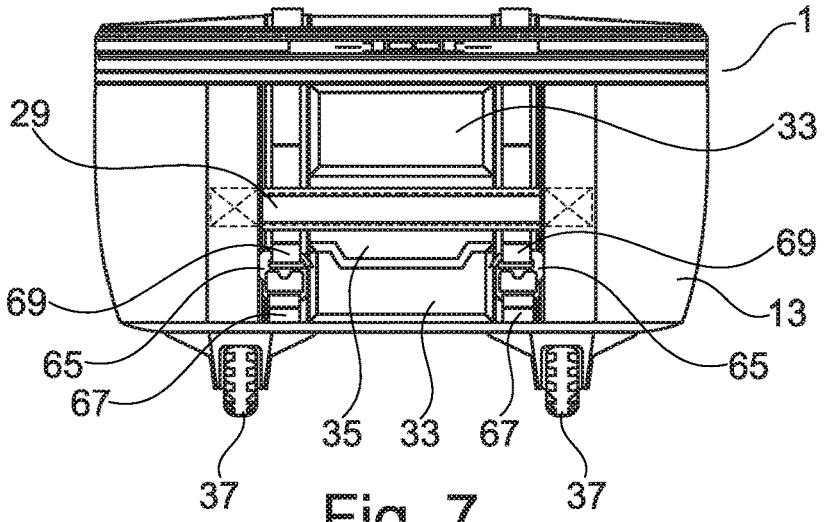
FIG. 7 illustrates the rear wall of the bag of FIGS. 1 to 6.
Figure 8:
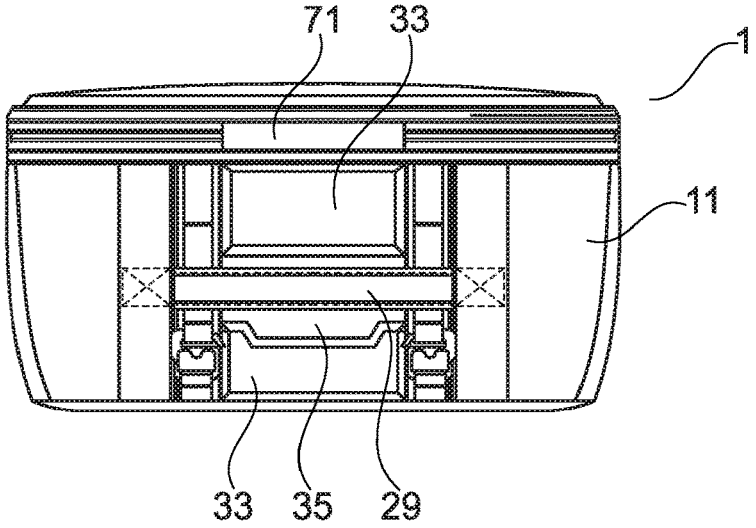
FIG. 8 shows the front wall of the bag of FIG. 7.

Additional padding or reinforcements may be provided in some other regions of the bag such as the nose region and/or in other choice regions. Additional layers are included in the rear wall and front wall, as shown in FIGS. 7 and 8. The nose region and/or the tail region of the bag may also include additional layers.

Figure 2:
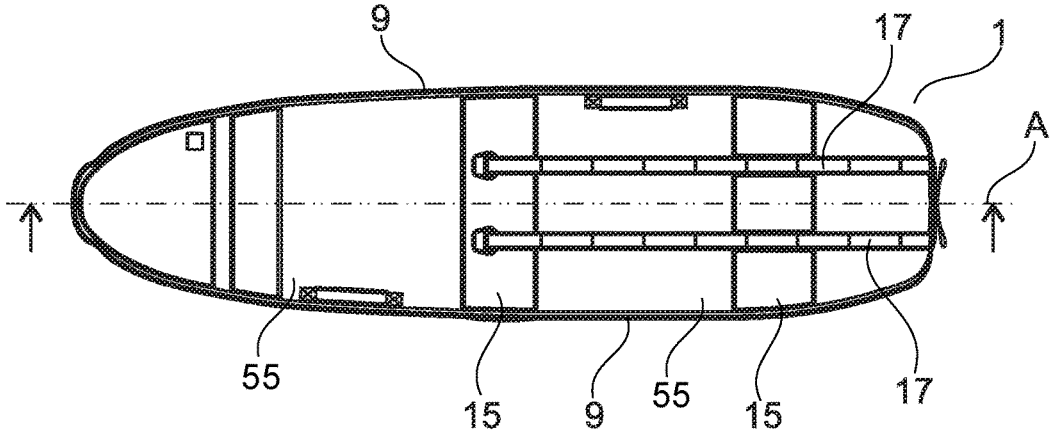
FIG. 2 shows a view of the bag of FIG. 1 from above.

A suitable material for reinforcement of the nose region, as well as the front and rear walls, is a thermoplastic panel (e.g. an EVA panel) potentially in conjunction with a PE plastic panel or some additional padding. In the nose region, the EVA panel has a length between 20 cm and 50 cm, preferably between 30 cm and 40 cm, most preferably around 34 cm in a standard size surfboard bag. In some cases, a stronger panel such as a honeycomb plastic panel as is used to for the strengthening non-foldable ribs can be used in the nose, at least in the upper wall, but generally the nose region will be more bendable than the ribs and may be foldable. The reinforced regions at the nose end are shown in FIGS. 1, 2, and 3 as parts 25. In this case additional layers are used both in the upper wall and bottom wall near to the nose end. A reinforcing nose panel may be provided in the upper wall only, the bottom wall only, in the bottom and upper walls only, or in some cases also in the side wall either side of the nose region. It is preferred to include a reinforcing nose plate in the upper and bottom walls only to allow for compression of the bag into its compact configuration as will be described below.

Reinforcing structures may also be provided at the tail end in the upper wall, bottom wall, or both as shown in FIGS. 2 and 3 as parts 27. These may also be in the form of one or more plastic or thermoplastic sections inserted between layers of the fabric of the bag (e.g. press-moulded EVA, extra padding, and/or a thin PE plate). In some cases, the reinforcements in the upper and bottom walls at the nose and tail end may simply comprise additional layers of foam or the provision of thicker layers of foam. These regions may be less stiff than the rib sections of the strengthening ribs (and may be foldable or may be bendable but not foldable), but stiffer than the soft foldable wall regions located in the region of the bag walls located between the or each pair of ribs. These regions may or may not be foldable. A preferred option is to include additional nose and tail reinforcements in the upper walls and potentially also the bottom walls and front and rear walls only, with the side walls where ribs are not provided all being foldable (such as being formed of two fabric layers with padding in between).

A handle may be provided on the rear and/or front walls. These are shown in FIGS. 7 and 8 as handles 29 on the front wall and rear walls. The rear and front walls may also include thicker panels 33 which are shaped to include indented sections 35 to increase ease and comfort when using the handle to lift or pull the bag. These panels may be thermoformed from EVA or another thermoplastic. The bag may additionally be designed to support wheels 37 for transport, and the region of the bottom wall to which the wheels are coupled may also include additional reinforcements, and this may be a honeycomb plastic layer or a simple plastic layer. The wheels may be coupled to a region of the bottom wall adjacent the tail end, and this, like the ribs, may be provided with plastic panels (honeycomb or solid) for additional stiffness in order to provide proper support for the wheels. The wheels can be permanently attached to the underside of the bag, e.g by way of bolts, or may be removable. Preferably, two wheels 37 will be provided on the bottom wall near to the tail end, but these can be located in other regions of the bag, such as on the upper wall or the rear wall, in some cases.

Figure 5:
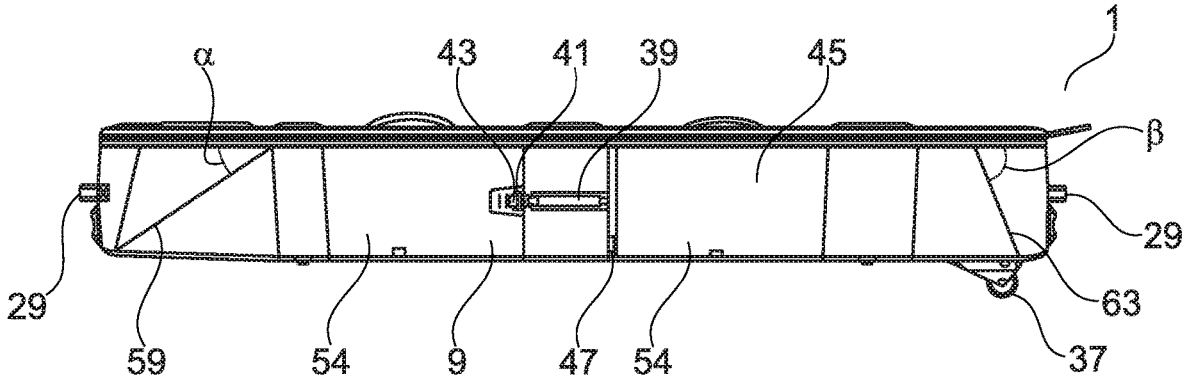
FIG. 5 shows the bag of FIG. 4 from the opposite side.

The bag can include additional handles and pockets within the lining, closable by way of a zip, buckles, buttons, Velcro® or any other fastening means. In some cases, handles can comprise one or two free ends which can be removably fixed to the side, upper, or bottom wall using a hook or a similar securing mechanism. If one free end is provided, a pockets can be located within the lining of the bag next to the fixed end of the handle, so that the free end can be un-clipped and the handle tucked away inside the pocket when not in use. FIG. 5 illustrates such a handle 39 having a free end with a hook 41 for fixing to loop 43 on the side of the bag. The section directly adjacent the fixed end of the handle is a pocket 45 having an opening 47 along the side facing the handle into which the handle can be inserted.

The protective structures formed by the ribs extending all of the way around the bag are shown in at least FIGS. 1 to 5. In the example depicted, three separate ribs loop around the bag in three different longitudinal positions along the length of the bag. One rib is located near to the tail end, one in the middle, and a third near to the nose end of the bag. The ribs may be the same width, but preferably will comprise a narrower rib extending around the base, top, and sides of the bag near to the nose end, a wider rib extending around the base, top, and sides of the bag in the middle and an even wider rib at the tail end to help achieve a compact and protected structure when the bag is rolled.

Figure 6:
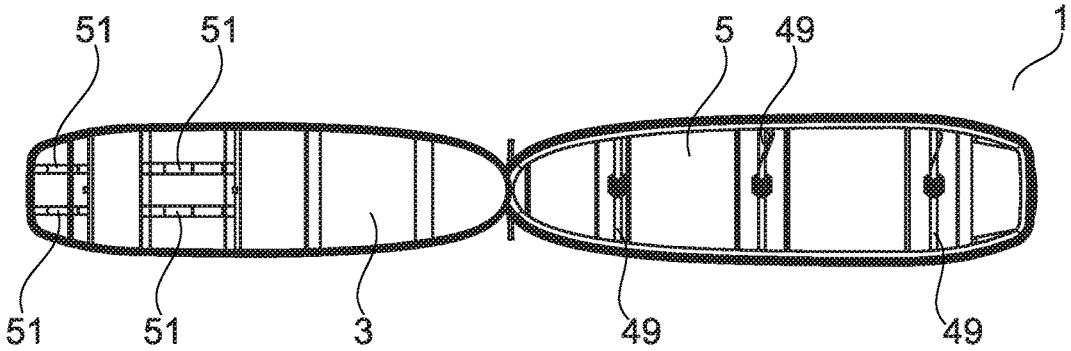
FIG. 6 shows the bag with the upper wall unzipped or unfastened and flipped outwards at a hinge.

The ribcage structure, comprising two or more ribs which can extend laterally all of the way around the bag to encircle the bag, and which are spaced apart in a longitudinal direction, protects the contents of the bag but also allows the bag to be compressible into a compact form for transport. Each rib will generally be formed of four separate rib sections which abut one another to encircle the enclosure. One way in which conversion to a compact form can be achieved is to design the upper wall so that it is hinged or is permanently affixed to the sides of the bag only at one end, such as at the nose end. The hinge for the upper wall in the examples shown in the figures is marked as part 71 in FIG. 8. This end hinging of the upper wall is not seen in traditional board bags, wherein the upper wall is hinged along the side of the bag to open from the opposite side. The upper wall is attached to the side panel by a fastener, such as a zip, which extends all of the way along one side, around the tail end, and along the other side of the upper wall. A hinge is formed at the nose end of the upper wall by attachment to the side wall. FIG. 6 illustrates the bag with the upper wall unzipped and flipped outwards via the hinge at the nose end to show the interior of the bag. The interior can include adjustable fixing straps 49 to help keep the surfboard or surfboards in place. One or more interior looped rails 51 can also be provided, for attaching additional bags and equipment if desired.

The regions of the side walls between the ribs (shown as panels 53 in FIGS. 4 and 5) will be foldable. The regions of the upper wall between the ribs (shown as panels 55 in FIGS. 1 and 2) and/or the regions of the bottom wall between the ribs (shown as panels 57 in FIG. 3) may also be foldable. In order to be able to fold the bag into its compact form using the method described below, at least a portion of the side walls closest to the rear wall and the front wall should be foldable.

Figure 10A:
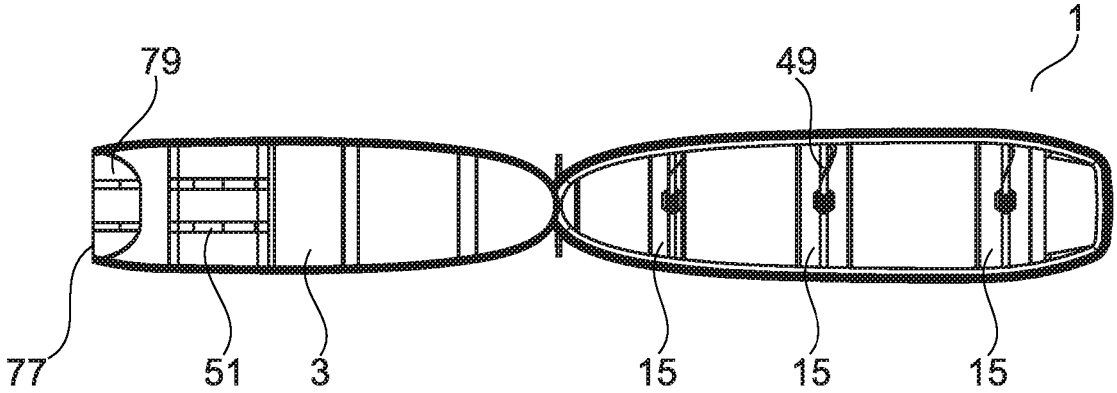
FIGS. 10A to 10E illustrate a folding mechanism for converting the bag from an assembled form to a compact form.
Figure 10B:
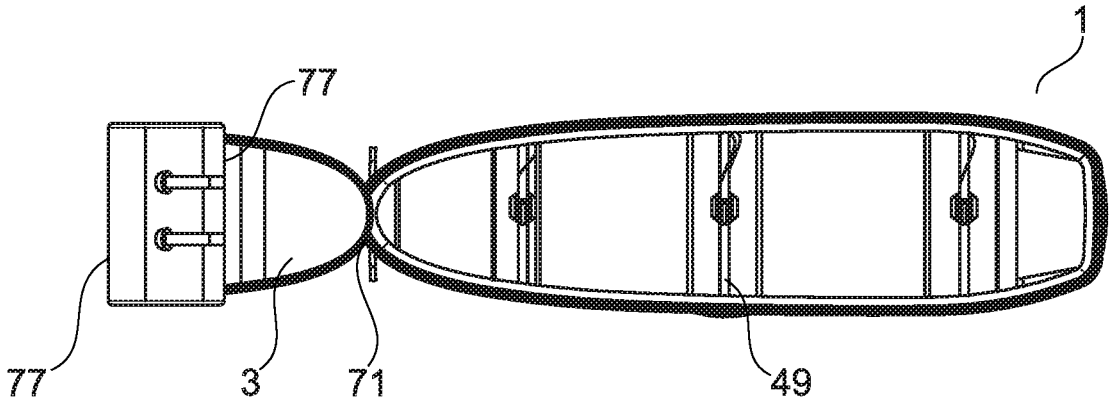
Figure 10C:
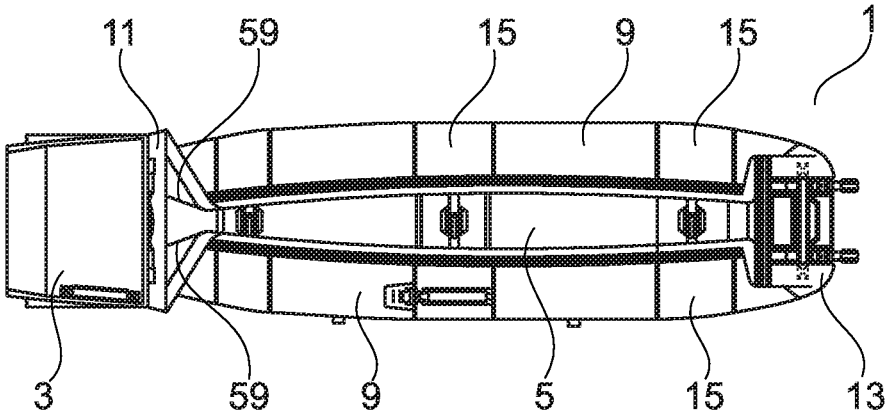

FIGS. 10A to 10E illustrate the process of folding the bag into its more compact form. Initially, the upper wall is unzipped or unfastened so that it is coupled to the side wall only at an end. This will usually be the nose end so that the bag is opened out as shown in FIG. 6. The upper wall can then be rolled up by folding it panel by panel along a series of lateral folds or seams 77 between bendable padded panels and rib sections of the upper wall. FIG. 10A shows the upper wall beginning to be rolled up by flipping the panel 79 at the free end of the upper wall over on top of the adjacent panel, which in this case is a reinforced rib section. In FIG. 10B the upper wall has been rolled further by continuing to flip the outer end of the upper wall over the adjacent panel. The upper wall between the rib sections can comprise intermediate sections which are not reinforced, such as panels 55. These are foldable and do not comprise additional strengthening plates, such as the honeycomb PE plates of the ribs, but are still thicker than the folds or seams provided between the panels, so that the upper wall will fold preferentially at the seams between the foam panel sections or between the foldable foam panel sections and the rib sections. These intermediate panels may be formed from a double layer of PE foam, as explained above. The upper wall can be folded by flipping each section over at the adjacent fold to roll the upper wall into a flat roll as shown in FIG. 10C.

The nose end of the bag is provided with a pair of diagonal folds. In this case the folds are formed as seams between adjacent foldable panels. One fold is provided on either side wall extending from the upper wall diagonally across the side wall to the bottom wall in a direction towards the adjacent end wall. These are shown as folds 59 in FIGS. 1, 4, 5, and 9, and are visible from the inside of the bag in FIG. 10C. The angle $\alpha$ between the diagonal fold and the upper edge of the side wall may be between 30° and 60°, preferably between 40° and 50°, and most preferably around 45°. The diagonal fold may meet the upper edge of the side wall at or adjacent the edge of the first encircling rib as shown in the figures and may meet the lower edge of the side wall adjacent the (possibly reinforced) front wall of the bag. The sections 61 on either side of the bag between the diagonal fold and the front wall of the bag are each flexible and foldable, and the front end of the bag can therefore be squashed down by folding along the diagonal folds 59 on either side. The fact that the side wall folds preferentially along the diagonal fold results in a natural opening or splaying outwards of the foremost part of the side walls outwards as shown in FIG. 100. The fold is formed by way of a seam provided between triangular or trapezoidal panels. The panels themselves may comprise foam padding as described above.

Figure 10D:
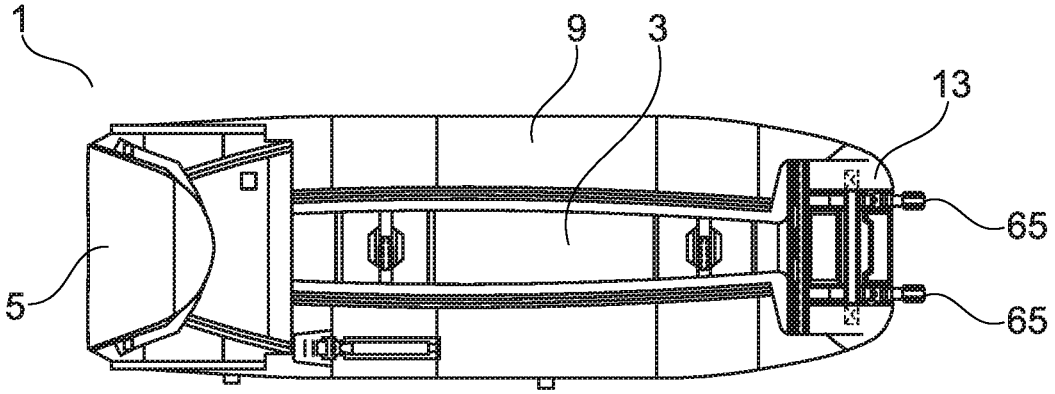
Figure 10E:
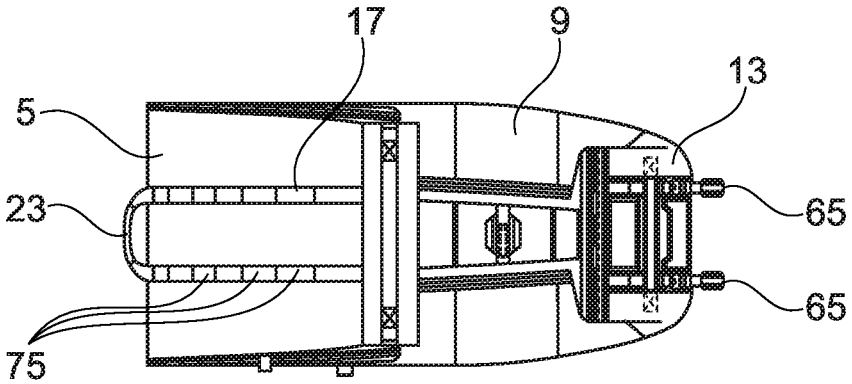

Prior to or at the same time as pressing the end wall down flat, the side walls can be folded inwards along the length of the bag by folding along the seams between the bottom wall and the side panel as shown in FIG. 10C, and the bag can be rolled up around the upper wall by folding along the edges of each of the rib sections (FIGS. 10D and 10E). Foldable panels between the rib sections can bend around the inner parts of the roll so that the final shape of the compressed bag is as small as possible, and is generally somewhere between a flat and a cylindrical roll. The locations of the ribs, or at least the ribs located in the middle and closer to the tail end of the bag, are carefully selected so that they coincide roughly with the ends of the slightly flattened rolled structure once the bag is in its compact configuration. This helps with the rolling and results in improved protection for any contents and to the bag itself even when the bag is compacted.

An additional pair of diagonal folds 63 can be provided on either side of the bag at the opposite end to allow the same folding mechanism to be used to compress the wall at the other end of the bag down in the same manner to also be rolled up with the rest of the bag. In FIG. 100 the side walls have been folded inwards and both the front and rear walls pressed down flat over the ends of the side panels using the respective pairs of diagonal folds 59 and 63.

In the example shown in the figures it is the front wall from which the upper wall is hinged, but the hinge may be provided on the rear wall, in which case reference to the front wall above will be to the rear wall, and vice versa. Depending on the shape and function of the bag, the upper wall can be hinged anywhere along the side panel, and the bag rolled around the upper wall from this region. The additional folds 63 may be oriented at the same angle or within the same range of angles as folds 59, or may be oriented more towards the vertical at an angle $\beta$ of between 40° and 80°, more preferably between 50° to 80°, and most preferably around 70° to the upper edge of the side wall.

Figure 11:
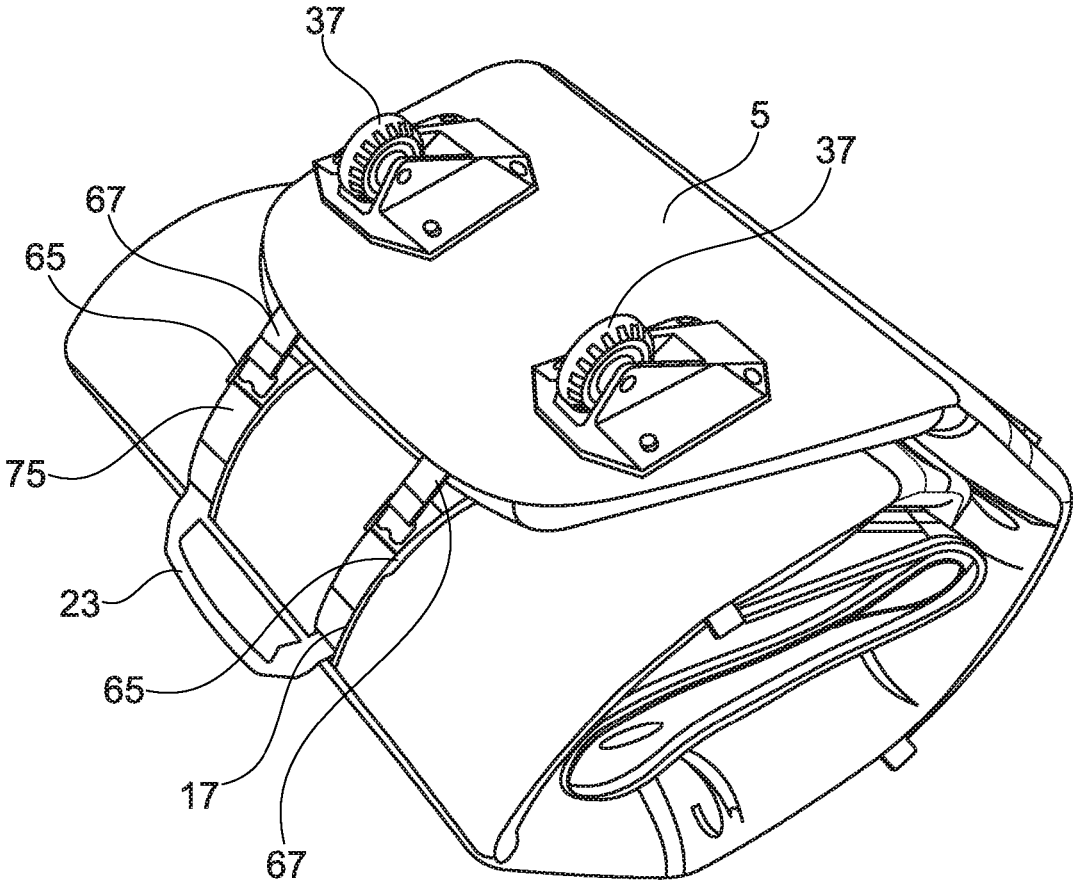
FIG. 11 illustrates the bag in its compact or compressed configuration.

Once the bag has been rolled up fully, it may be fastened in the compact configuration as shown in FIG. 11 using fastening means. In the example shown, the fastening means comprise the one or more hooks or buckles 65 attached to the rear wall of the bag (or between the rear wall and the bottom wall) which couple to the one or more corresponding rails 17 provided on the underside of the bag for this purpose. The rails can be seen also in FIG. 10E before the bag has been fully compacted, and are formed of a series of loops 75 through which the buckle/hook 65 can be hooked or clipped. Providing a series of fastening points along the length of the underside gives some flexibility in terms of how tightly rolled the bag is. The bag can be rolled with a small piece of equipment inside if desired, for example, in which case it will be less tightly rolled and different loops or fastening points might be used to fasten it in its compact configuration. The additional loops also provide fastening points for other equipment or other bags. The hooks or buckles can be provided on the rear wall of the bag attached at the base of the rear wall adjacent the bottom wall as shown in FIG. 10E via a strap 67. Loops 69 can also be provided also closer to the top of the rear wall for attaching the hooks 65 when the bag is in use. This prevents the straps with the hooks from flapping around or becoming caught during use. The handle 23 provides a convenient way to transport the bag when in its compact form.

Figure 9:
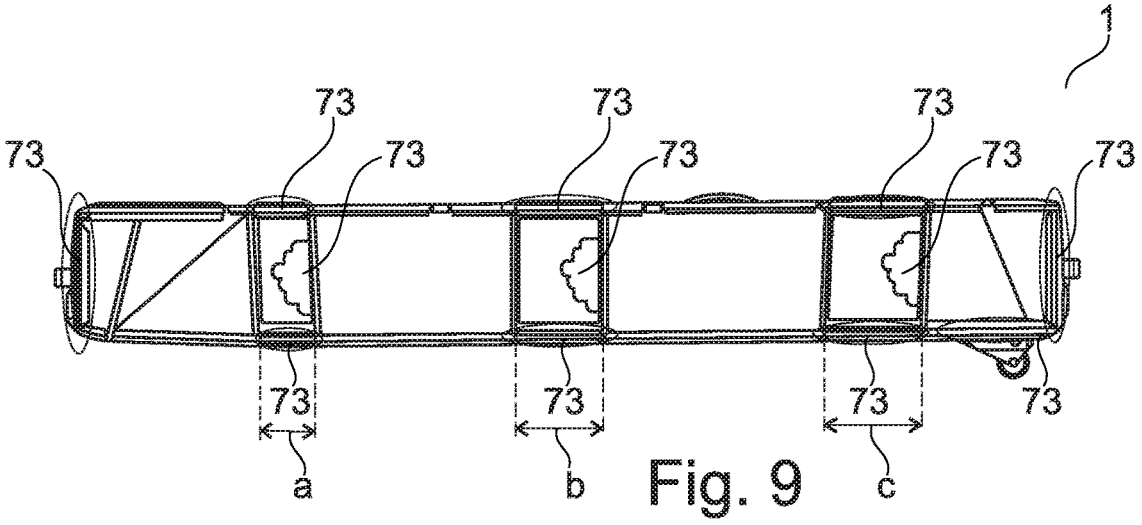
FIG. 9 illustrates some possible positions for including reinforced panels in the side panel and the upper and lower panels of the bag.

The width of the ribs may increase from the end to which the upper wall is coupled via the hinge, usually the nose end, towards the opposite end. This can be seen clearly in FIG. 9 in which width a is less than width b, which is less than width c. Regions of the bag with additional reinforcements in the form of honeycomb panels in one example are shown in FIG. 9 as regions 73, and these include the rib sections of the ribs. Honeycomb panels may be present only in the rib sections in some examples. This increase in width of the ribs from the nose to the tail end of the bag (or vice versa if the bag is rolled from the tail end) helps with the rolling, because as the bag is rolled up and the rolled section becomes larger, wider reinforced panels can be present without resulting in an increased size for the rolled-up bag.

In its compact or rolled configuration, the bag still receives some protection from at least some of the reinforced panels forming the rib sections, which are generally located at the ends of the flat rolled structure, as can be seen in FIG. 10E.

The two pairs of diagonal folds 59 and 63 allow the end walls to be pressed down at least partly due to the fact that the sides of the bag include bendable or softer regions between the diagonal fold and the end of the bag. The soft regions could be replaced with stiffer regions with additional folds to allow the end to be opened out and pressed flat, but this is not necessary since protection is amply provided by the ribs, preferably along with additional reinforcements at both of the nose and tail ends of the bag.

The specific example of a bag shown in the figure is a surfboard bag, however the protective ribcage structure and the folding mechanism are each clearly applicable to bags having different shapes for carrying different types of equipment. The lower wall may represent the back wall of a rucksack, for example.

The bag can be scaled down as a skateboard bag, for example, or elongated further as a ski bag. Any shape of bag can be provided with a strengthening rib or two or more strengthening ribs forming a ribcage structure for additional strength, and any shape of bag can be provided with foldable regions to allow the bag to be collapsed into a compact configuration.

The invention claimed is:

1. A bag for carrying sports equipment comprising:

an upper wall, a bottom wall, and a side panel extending between the upper wall and bottom wall to form an enclosure for containing the sports equipment, wherein the upper wall is removably coupled to the side panel along at least a part of its perimeter to provide access to the enclosure;

a first strengthening rib comprising a first rib section extending across the upper wall, a second non-foldable rib section extending across the side panel on a first side of the bag, a third non-foldable rib section extending laterally across the bottom wall, and a fourth non-foldable rib section extending across the side panel on a second side of the bag opposite the first side, wherein the rib sections are arranged to abut each other such that they completely surround the enclosure;

a second strengthening rib offset longitudinally along a length of the bag from the first strengthening rib, the second strengthening rib having the same structure as the first strengthening rib;

a third strengthening rib offset longitudinally from the first and the second strengthening ribs, the third strengthening rib having the same structure as the first and second strengthening ribs; and at least one foldable region adjacent the first strengthening rib, wherein the upper and bottom walls are elongated and the first, second and third strengthening ribs are spaced longitudinally along the bag so as to be located adjacent a first end, about half way along the bag from the first to a second end, and adjacent the second end of the bag respectively and the at least one foldable region comprises a first foldable region located between the first and second strengthening ribs.

2. The bag of claim 1, wherein the first rib section is non-foldable.

3. The bag of claim 1, wherein the first, second, third, and fourth, rib sections are provided at the same longitudinal distance from an end of the upper wall.

4. The bag of claim 1, wherein the first, second, third, and fourth rib sections have a constant width that is the same for each of the rib sections.

5. The bag of claim 1, wherein the at least one foldable region extends around each of the upper wall, the bottom wall, and the side panel on the first and second sides of the bag.

6. The bag of claim 1, wherein the upper wall, side panel, and bottom wall between the first and second strengthening ribs is foldable.

7. The bag of claim 1, wherein the whole of the upper wall, first side, second side, and bottom wall between the first and second strengthening ribs, and between the second and third strengthening ribs is foldable.

8. The bag of claim 1, wherein a width of the strengthening ribs increases from one end of the bag to the other.

9. The bag of claim 1, wherein the bag is a surfboard bag.

10. The bag of claim 1, wherein the side panel comprises two side walls, a front wall, and a rear wall, and wherein the bag comprises a pair of diagonal folds adjacent the front wall of the bag and extending across the side panel from the bottom wall to the upper wall on either side of the bag such that the side panel folds along the diagonal folds to compress the front wall of the bag down flat and the side panel between each of the pair of diagonal folds and the front wall of the bag is foldable.

11. The bag of claim 10, comprising a second pair of diagonal folds adjacent the rear wall of the bag and extending across the side panel from the bottom wall to the upper wall on either side of the bag for compressing the rear wall of the bag down flat.

12. The bag of claim 1, wherein the first, second, third, and fourth rib sections are formed as four separate panels within each of the upper wall, bottom wall, and the side panel on either side of the bag.

13. The bag of claim 1, wherein the at least one foldable region is a foldable panel.

14. A bag for carrying sports equipment comprising:

an upper wall, a bottom wall, and a side panel extending between the upper wall and bottom wall to form an enclosure for containing the sports equipment, wherein the upper wall is removably coupled to the side panel along at least a part of its perimeter to provide access to the enclosure; and a first strengthening rib comprising a first rib section extending across the upper wall, a second non-foldable rib section extending across the side panel on a first side of the bag, a third non-foldable rib section extending laterally across the bottom wall, and a fourth non-foldable rib section extending across the side panel on a second side of the bag opposite the first side, wherein the rib sections are arranged to abut each other such that they completely surround the enclosure, wherein the side panel comprises two side walls, a front wall, and a rear wall, and wherein the bag comprises a first pair of diagonal folds adjacent the front wall of the bag and extending across the side panel from the bottom wall to the upper wall on either side of the bag, a second pair of diagonal folds adjacent the rear wall of the bag and extending across the side panel from the bottom wall to the upper wall on either side of the bag such that the side panel folds along the first and second pairs of diagonal folds to compress the front and rear walls of the bag down flat, the upper wall is coupled to the side panel via a hinged region at a front or a rear end of the bag, and wherein the bag can be opened by flipping the upper wall outwards about the hinged region, and the bag is convertible from an assembled configuration wherein the upper wall, bottom wall, and side panel form the enclosure, to a compact configuration by opening the upper wall out at the hinged region and rolling the upper wall up from a free end towards the hinged region, collapsing the side walls of the bag inwards, compressing the front and rear end walls of the bag flat by folding the side panel along the first and second pairs of diagonal folds, and rolling the bottom wall and side walls around the upper wall.

15. The bag of claim 14, comprising fastening means on the bottom wall for cooperating with fastening means at the rear end of the bag to secure the bag in its compact form.

16. The bag of claim 14, wherein the first rib section is non-foldable.

17. The bag of claim 14, comprising a second strengthening rib offset longitudinally along a length of the bag from the first strengthening rib, the second strengthening rib having the same structure as the first strengthening rib;

a third strengthening rib offset longitudinally from the first and the second strengthening ribs, the third strengthening rib having the same structure as the first and second strengthening ribs; and at least one foldable region adjacent the first strengthening rib, wherein the upper and bottom walls are elongated and the first, second and third strengthening ribs are spaced longitudinally along the bag so as to be located adjacent a first end, about half way along the bag from the first to a second end, and adjacent the second end of the bag respectively and the at least one foldable region comprises a first foldable region located between the first and second strengthening ribs.

18. The bag of claim 17, wherein a width of the strengthening ribs increases from one end of the bag to the other.

19. The bag of claim 17, wherein the whole of the upper wall, first side, second side, and bottom wall between the first and second strengthening ribs, and between the second and third strengthening ribs is foldable.

20. The bag of claim 14, wherein the first, second, third, and fourth rib sections have a constant width that is the same for each of the rib sections.

* * * * *